United States Patent [19]

Tietze

[11] Patent Number: 4,714,288

[45] Date of Patent: Dec. 22, 1987

[54] REMOTE RELEASE TOW HOOKS

[75] Inventor: Richard C. Tietze, Ft. Pierce, Fla.

[73] Assignee: Harbor Branch Oceanographic Institution Inc., Ft. Pierce, Fla.

[21] Appl. No.: 40,044

[22] Filed: Apr. 13, 1987

[51] Int. Cl.[4] ..... B66C 1/36

[52] U.S. Cl. ..... 294/82.33; 24/241 PP; 294/82.27; 114/252

[58] Field of Search ..... 294/75, 82.25, 82.27, 294/82.3, 82.31, 82.33, 82.34, 82.36; 24/230.5 R, 232 R, 233, 241 P, 241 PP, 241 PS, 241 SP, 241 SB; 114/230, 249, 252, 253; 280/504, 508

[56] References Cited

U.S. PATENT DOCUMENTS

| | | | |
|---|---|---|---|
| 2,429,769 | 10/1947 | Petouhoff | 294/82.33 |
| 3,259,418 | 7/1966 | Munday et al. | 294/82.33 |
| 3,763,815 | 10/1973 | Hodate | 294/82.27 X |
| 4,034,992 | 7/1977 | Epstein | 294/82.33 |
| 4,061,103 | 12/1977 | Mampaey | 294/82.27 X |
| 4,201,410 | 5/1980 | Crawford et al. | 294/82.33 |
| 4,611,842 | 9/1986 | Epstein | 294/82.33 |

*Primary Examiner*—Johnny D. Cherry
*Attorney, Agent, or Firm*—Carroll F. Palmer

[57] ABSTRACT

A device with which a tow line may be attached to a towed object, e.g., a submarine vessel, and then detached remotely includes a body member, a trip member, a latch and a keeper member. The body member has a pivot portion and an integral tow portion. The pivot portion includes a first arcuate section integral with the tow portion, a second arcuate section hinged to the first arcuate section and fastener means to forceably close the second section upon the first section forming a circular opening in the the pivot portion, which opening serves as the means for connection of the device to the towed object. The tow portion is J-shaped while the trip member is C-shaped and is pivoted on the tow portion to swing between a latched position and a release position. The latch includes a hook member pivoted on the tow portion and a ledge on the trip member is positioned so that the hook member can engage the ledge to retain it in the latched position. A piston which can be operated from a remote location moves the hook member into and out of engagement with the ledge. The keeper is pivoted on the trip member to swing from a tow line admission position to a tow line retention position and spring means biases the keeper member into the retention position.

5 Claims, 12 Drawing Figures

FIG. 1
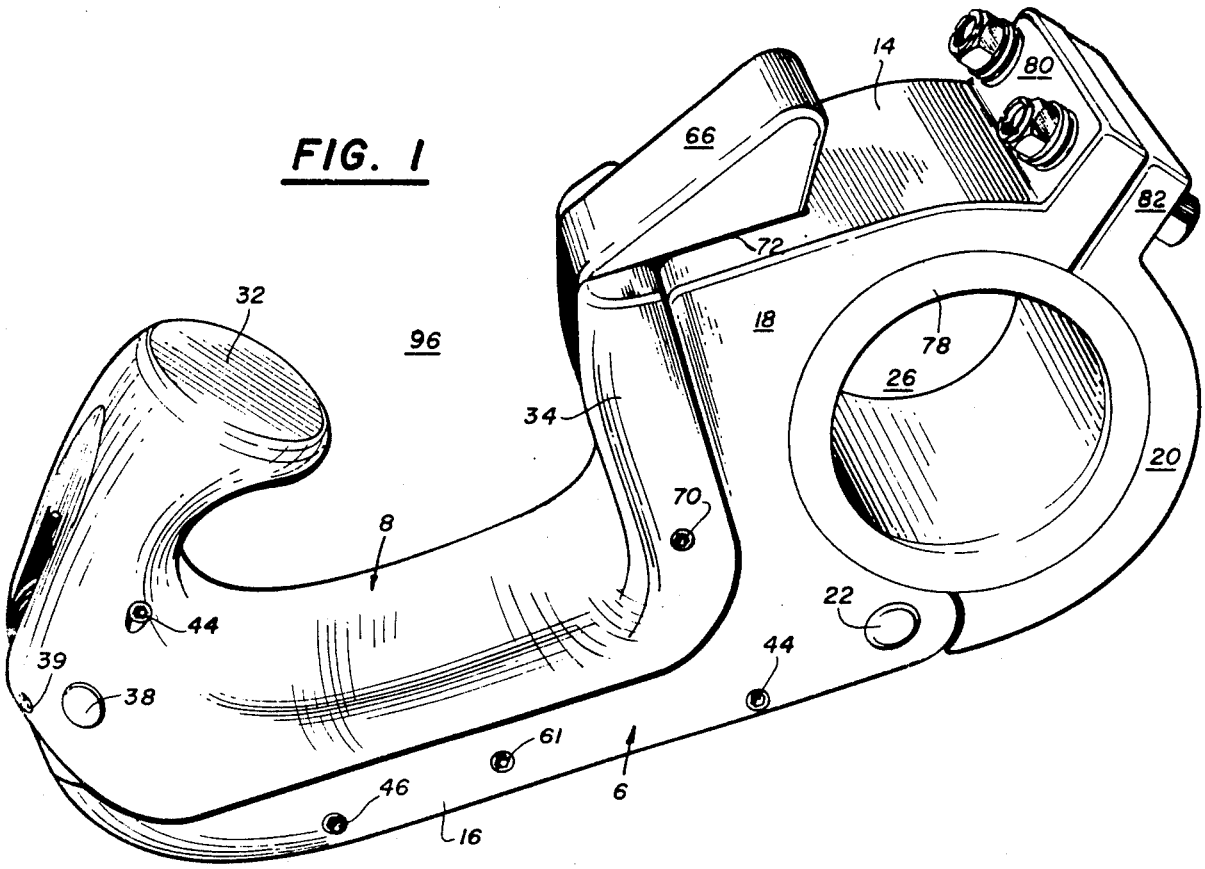
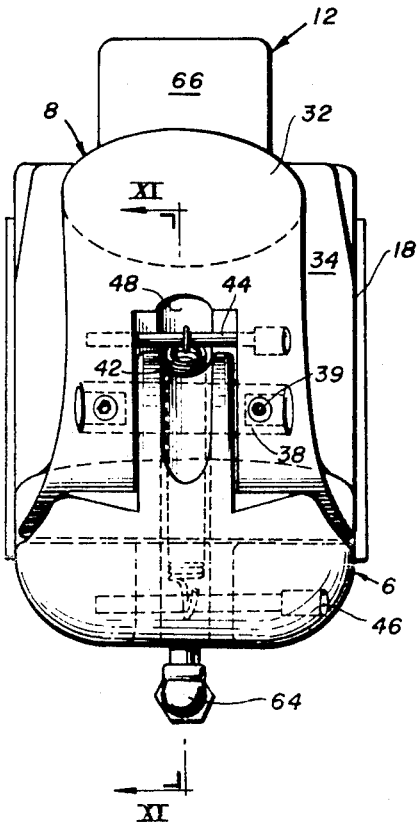
FIG. 2

REMOTE RELEASE TOW HOOKS

BACKGROUND OF THE INVENTION

1. Field of the Invention

This invention relates broadly to releasable tow hooks. More particularly, it concerns hook devices with which a tow line may be attached to a towed object, e.g., a a manned submersible, and then detached remotely.

2. Description of the Prior Art

There is a need in many different type operations for hook devices by which a line may be temporarily connected to the hook device and later released from a location remote from the hook device. The need for the remote releasing may be (a) to protect the person making the release from injury, (b) because the hook device at the time of required release is inaccessible to the operator, etc.

In simpler types of remote release hook devices, the release is performed by a lanyard or like line. Such units have been designed for helicopter cargo loading hooks (U.S. Pat. No. 3,068,034), mooring bouys (U.S. Pat. No. 3,193,318), load lifting hooks (U.S. Pat. No. 3,918,758) and raft & boat davits (U.S. Pat. No. 4,379,579).

In more complicated types of remote release hook devices, the release is performed by radio control, hydraulic lines, or other means more complex than a lanyard. For example, such units have been used for safety purposes in the mooring of ships and boats to a dock, e.g., see U.S. Pat. Nos. 3,811,720; 4,034,992 and 4,389,907.

The present invention relates to remote release hook devices of the latter type particularly designed for use in the towing of submersible vessels.

In the launching and recovery of a manned submersible, a tow line is attached thereto by which it may be towed to a desired location and then released. In order to effect such release without use of a diver to accomplish it, some form of hook device is needed to permit a person in the submersible or at some other remote location to release the tow line to enable the submersible to then proceed under its own power to perform whatever task has been assigned to it.

The present invention provides improved remote control release hook devices that are particularly useful in the towing of submersible vessels, but which may also be adapted for use in a variety of other applications.

OBJECTS

A principal object of the invention is the provision of remote release hook devices by which a tow line may be attached to a towed object, e.g., a submarine vessel, and then detached remotely when required.

Further objects include the provision of:

1. Such hook devices that can function with tow lines having only a soft eye in the attachment end which can be inserted in the tow hook without disengaging the device.

2. Such devices in which the tow line may be inserted using only one hand and wherein a keeper holds the line in place until tension is applied.

3. Such devices which automatically reset themselves once the tow line has been cleared.

4. Such devices wherein the hook is automatically aligned with tension in the vertical plane.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of hook devices with which a tow line may be attached to a towed object and detached remotely when the need arises.

The new hook devices basically comprise a body member, a trip member, latch means and a keeper member.

The body member comprises a pivot portion and a tow portion integral with the pivot portion, both such portions lying in the same longitudinal plane. The pivot portion includes a first arcuate section integral with the tow portion, a second arcuate section hinged to the the first arcuate section and fastener means to forceably close the second section upon the first section forming a circular opening in the the pivot portion transverse to the longitudinal plane, which opening serves as the means for attachment of the device to the towed object.

The tow portion is J-shaped with an elongated leg section that extends along the longitudinal axis of the body member and an arcuate end section.

The trip member is C-shaped and integrally includes an arcuate proximal section, an distal section and a central section. The trip member is pivoted by the proximal section on the tow portion end section to swing between a latched position and a release and a release position, and there is spring means to bias the trip member into the latched position.

The latch means comprises a hook member pivoted at its fixed end on the elongated leg section to swing in the longitudinal plane. There is a ledge on the trip member positioned so the the hook member can engage the ledge to retain the latch means in the latched position and piston means moves the hook member into and out of engagement with the ledge.

The keeper means comprises a keeper member of generally triangular cross-section pivoted at one end on the trip member distal section to swing from a tow line admission position wherein it enters a mating notch in the first arcuate section of the pivot portion to a tow line retension position out of the notch and spring means to bias the keeper member into the retension position.

In preferred embodiments of the invention, a split bushing lines the inner surface of the circular opening of the pivot portion. Also, the fastener means includes an integral first lug that extends laterally from the first arcuate section, an integral second lug that extends laterally from the second arcuate section and at least one bolt that extends through aligned bores in the first and second lugs. Further, the piston means is a double-action compressed air cylinder with attached couplers for connecting the cylinder to compressed air supply lines. Additionally, the device includes a coil spring to bias the trip member into the retension position.

BRIEF DESCRIPTION OF THE DRAWINGS

A more complete understanding of the invention may be had by reference to the accompanying drawings in which:

FIG. 1 is a perspective view of a remote control hook device of the invention shown with its keeper member moved into the tow line reception position.

FIG. 2 is an end view of the hook device of FIG. 1.

DESCRIPTION OF THE PREFERRED EMBODIMENTS

Figure 12:
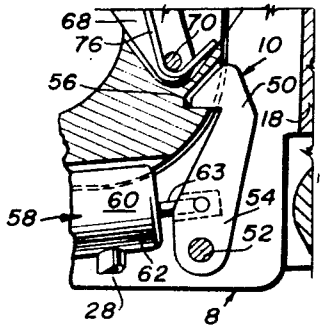
FIG. 12 is a fragmentary, lateral sectional view of the latch means of the new devices of the invention.

Referring in detail to the drawings, in which identical parts are identically marked, the invention comprises a hook device 2 with which an eye of tow line 4 may be attached to a towed object (not shown) and later detached remotely which comprises a body member 6, a trip member 8, a latch means 10 and a keeper member 12.

The body member 6 comprises a pivot portion 14 and a tow portion 16, both such portions lying in the same longitudinal plane.

The pivot portion 14 includes a first arcuate section 18 integral with the tow portion 16, a second arcuate section 20 hinged by pin 22 to the the first arcuate section 18 and fastener means 24 to forceably close the second section 20 upon the first section 18 forming a circular opening 26 in the pivot portion 14 transverse to the longitudinal plane of the device 2. The opening 26 serves as the means for attachment of the device 2 to the towed object (not shown).

The tow portion 16 is J-shaped with an elongated leg section 28 that extends along the longitudinal axis of the body member 6 and an arcuate end section 30.

The trip member 8 is C-shaped and integrally includes an arcuate proximal section 32, a distal section 34 and a central section 36. The trip member 8 is pivoted at the proximal section 32 by pin 38 on the tow portion end section 30 to swing between a latched position (shown in solid in FIG. 3) and a release position (shown in dot-dash in FIG. 3). The pin 38 may be held in place with set screws 39.

Spring means 40 which biases the trip member 8 into the latched position includes a spring 42, retention pins 44 and 46 and receiving bores 48 in the body portion 6 and trip member 8.

The latch means 10 comprises a hook member 50 pivoted by pin 52 at its fixed end 54 on the elongated leg section 28 to swing in the longitudinal plane of the device 2. A ledge 56 on the trip member 8 is positioned so that the hook member 50 can engage it to retain the latch means 10 in the latched position.

There is a piston means 58 to move the hook member 50 into and out of engagement with the ledge 56 which includes a double-action cylinder 60 held by pin 61 at one end and connected at the other end 62 by linkage 63 to the hook member 50. Couplers 64 on the cylinder 60 permit it to be connected to compressed air supply lines (not shown).

The keeper means 12 comprises a keeper member 66 of generally triangular cross-section pivoted at end 68 by pin 70 on the grip member distal section 68 to swing from a tow line admission position (shown in FIG. 1) wherein it enters a mating notch 72 in the first arcuate section 18 of the pivot portion 14 to a tow line retention position (shown in solid in FIG. 3) out of the notch 72 toward the proximal section 32.

Spring means 74 in the form of a leaf spring 76 biases the keeper member 66 into its retention position.

A split bushing 78 lines the inner surface 80 of the circular opening 26 of the pivot portion 14.

The fastener means 24 includes an integral first lug 80 that extends laterally from the first arcuate section 18, an integral second lug 82 that extends laterally from the second arcuate section 20 and a pair of bolts 84 that extend through aligned bores 86 and bushings 88 in the first and second lugs 80 and 82. Flat washers 90 or spring washers 92 may be used to cooperate with nuts 94 on bolts 84 to force the lug 82 to toward lug 80 and close opening 26 about a cylindrical bar or the like on the object to be towed by line 4.

In use of the new device 2, the eye of the line 4 is placed in the throat 96 of the trip member 8 deflecting the keeper member 66 (see FIG. 1) to admit the line eye. The spring 76 immediately returns the keeper member 66 to the retention position (see FIG. 3) to trap the eye of line 4, if the line becomes slack. When tension is applied to the line 4, the body member 6, trip member 8 and keeper means 12 are allowed to pivot about the center 98 of opening 26 with the aid of bushing 78. Tension needed to produce the pivoting can be controlled by adjustment of the bolts 84. Such pivoting keeps the tow line 4, trip member 8 and pivot point 98 all aligned to reduce the load on the entire system.

To release the tow line 4, compressed air is introduced in cylinder 60 causing the latch member 50 to move off ledge 56 and release the trip member 8. This allows the trip 8 to pivot about the in 38 permitting the line 4 to escape (see FIG. 3 dot-dash portion). The keeper means 12 is again deflected as the eye of the tow line 4 passes it.

Figure 3:
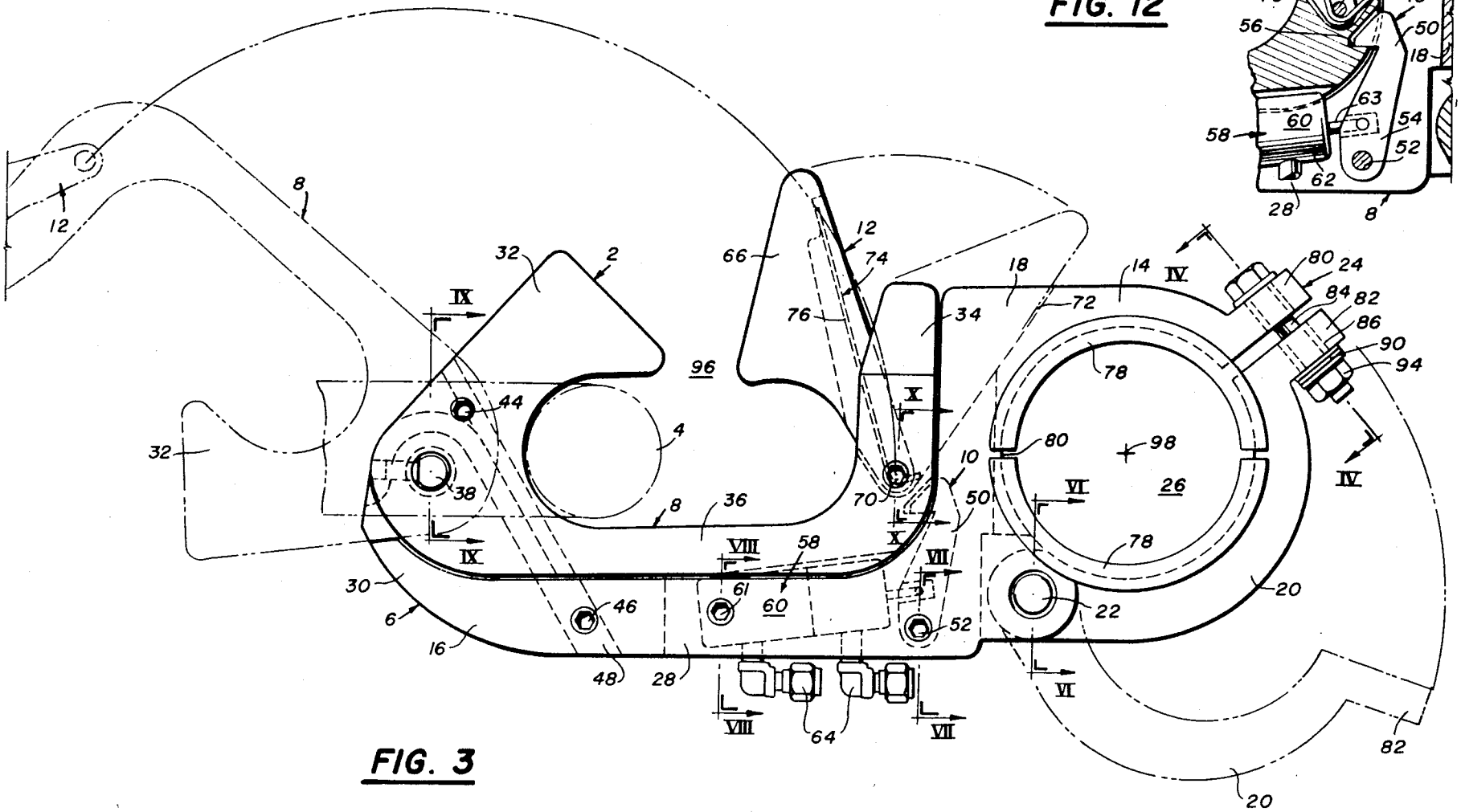
FIG. 3 is a lateral view of the hook device of FIG. 1 showing movement of parts thereof in dot-dash lines.
Figure 4:
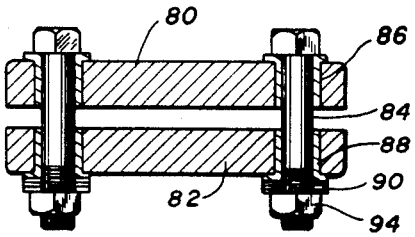
FIG. 4 is a sectional view taken on the line IV—IV of FIG. 3.
Figure 5:
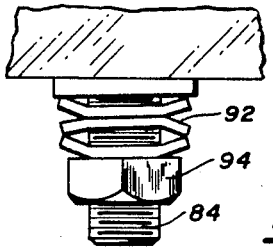
FIG. 5 is a lateral view of one bolt locking system for use in the new devices.
Figure 6:
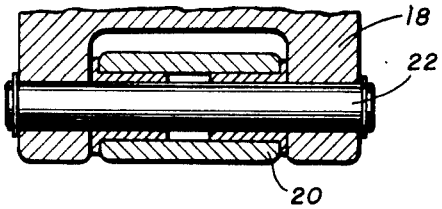
FIG. 6 is a sectional view taken on the line VI—VI of FIG. 3.
Figure 7:
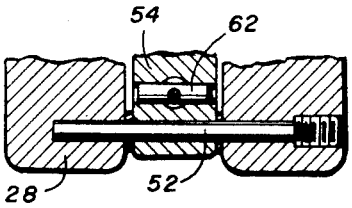
FIG. 7 is a sectional view taken on the line VII—VII of FIG. 3.
Figure 8:
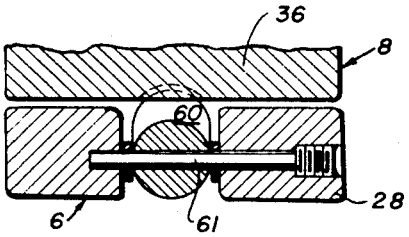
FIG. 8 is a sectional view taken on the line VIII—VIII of FIG. 3.
Figure 9:
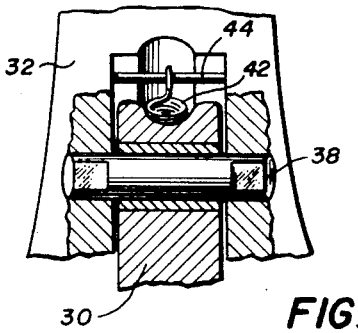
FIG. 9 is a sectional view taken on the line IX—IX of FIG. 3.
Figure 10:
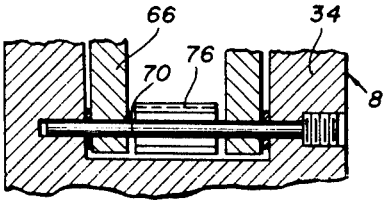
FIG. 10 is a sectional view taken on the line X—X of FIG. 3.
Figure 11:
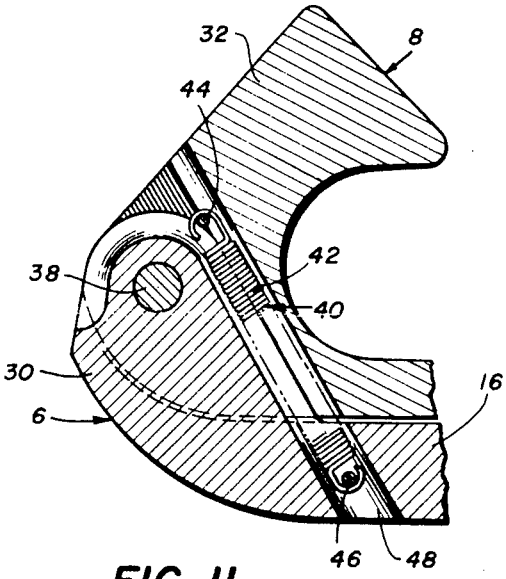
FIG. 11 is a sectional view taken on the line XI—XI of FIG. 2.

Once the eye of line 4 has been released, the spring 42 returns the trip member 8 to the latched position (see FIG. 3). At the same time, the pneumatic piston 60 with reverse pressure in the cylinder automatically reengages the latch member 50 onto the edge 56 thereby locking the trip member 8 to again hook a line.

The embodiments of the invention in which an exclusive property or privilege is claimed are defined as follows:

1. A device with which a tow line may be attached to a towed object and then detached remotely which comprises:

a body member, a trip member, latch means and a keeper member, said body member comprising a pivot portion and a tow portion integral with said pivot portion, both said portions lying in the same longitudinal plane, said pivot portion including a first arcuate section integral with said tow portion, a second arcuate section hinged to said first arcuate section and fastener means to forceably close said second section upon said first section forming a circular opening in the said pivot portion transverse to said longitudinal plane, which opening serves as the means for connection of said device to said towed object, said tow portion being J-shaped with an elongated leg section that extends along the longitudinal axis of said body member and an arcuate end section, said trip member being C-shaped and integrally including an arcuate proximal section, a distal section and a central section, said trip member being pivoted by said proximal section of said tow portion end section to swing between a latched position and a release position, and inclding spring means to bias said strip member into said latched position, said latch means comprising a hook member pivoted at its fixed end on said elongated leg section to swing in said longitudinal plane, a ledge on said trip member positioned so the said hook member can engage said ledge to retain said trip member in said latched position and piston means to move said hook member into and out of engagement with said ledge, and said keeper means comprising a keeper member of generally triangular cross-section pivoted at one end of said trip memver distal section to swing from a tow line admission position wherein it enters a mating notch in said first arcuate section of said pivot portion to a tow line retention position out of said notch toward said arcuate proximal section and spring means to bias said keeper member into said retention position.

2. The device of claim 1 wherein a split bushing lines the inner surface of said circular opening of said pivot portion.

3. The device of claim 1 wherein said fastener means includes an integral first lug that extends laterally from said first arcuate section, an integral second lug that extends laterally from said second arcuate section and at least one bolt that extends through aligned bores in said first and second lugs.

4. The device of claim 1 wherein said piston means is a double-action hydraulic cylinder with attached couplers for connecting said cylinder to compressed air supply lines.

5. The device of claim 1 including a coil spring to bias said trip member into said latched position.

* * * * *